US008919022B2

(12) United States Patent
Chewning et al.

(10) Patent No.: US 8,919,022 B2
(45) Date of Patent: Dec. 30, 2014

(54) HIGH CAPACITY FIREARM MAGAZINE FEED MECHANISM

(76) Inventors: Scott Ryan Chewning, Warren, OR (US); Jeff Scott Milton, Vancouver, WA (US); Eric Keith Krabbenhoft, Washougal, WA (US)

( * ) Notice: Subject to any disclaimer, the term of this patent is extended or adjusted under 35 U.S.C. 154(b) by 218 days.

(21) Appl. No.: 13/289,498

(22) Filed: Nov. 4, 2011

(65) Prior Publication Data

US 2012/0117840 A1 May 17, 2012

Related U.S. Application Data

(60) Provisional application No. 61/456,311, filed on Nov. 4, 2010.

(51) Int. Cl.
*F41A 9/75* (2006.01)
*F41A 9/70* (2006.01)

(52) U.S. Cl.
CPC .... *F41A 9/75* (2013.01); *F41A 9/70* (2013.01)
USPC ..... 42/49.01; 42/49.02; 89/33.02

(58) Field of Classification Search
USPC ..... 42/49.01, 49.02, 50, 6; 86/45, 46; 89/33.02
See application file for complete search history.

(56) References Cited

U.S. PATENT DOCUMENTS

| | | | | |
|---|---|---|---|---|
| 2,360,035 | A * | 10/1944 | Birkigt | 42/50 |
| 2,448,081 | A * | 8/1948 | Conway | 42/17 |
| 4,332,097 | A * | 6/1982 | Taylor, Jr. | 42/50 |
| 4,524,672 | A * | 6/1985 | Balsavage | 89/33.1 |
| 8,156,675 | B2 * | 4/2012 | Heath | 42/49.01 |

* cited by examiner

*Primary Examiner* — Daniel J Troy
(74) *Attorney, Agent, or Firm* — Chernoff Vilhauer McClung & Stenzel, LLP

(57) ABSTRACT

A device for modifying an existing high capacity magazine to reduce the friction between the bolt and the cartridges and assure more reliable feeding, by biasing the cartridge into the feed position in a manner independent of the magazine's primary spring pressure.

10 Claims, 5 Drawing Sheets

HIGH CAPACITY FIREARM MAGAZINE FEED MECHANISM

CROSS-REFERENCE TO RELATED APPLICATIONS

This application claims the benefit of the filing date of U.S. Provisional Patent Application No. 61/456,311, filed Nov. 4, 2010, the entire disclosure of which is hereby incorporated herein by reference for all purposes.

BACKGROUND

Semi-automatic and automatic firearms typically store cartridges in one of three ways: box magazines, drum magazines or belts.

Typical magazines are powered by a single spring whose function it is to move the cartridge upward toward the action as it cycles. This requires a spring which balances the speed necessary to move the entire stack of cartridges upward several times a second against the friction between the action and the top cartridge, which can tend to cause a stoppage. An overly powerful spring will create excessive friction, while a weak spring will fail to force a cartridge upward fast enough, creating stoppage. This balancing act must be successful for both a full magazine and a nearly empty one, as well as intermediate states, taking into account the changes in spring compression and total cartridge mass which occur as the gun is fired.

If the pressure exerted by the magazine on the top cartridge could be made more consistent regardless of the pressure exerted by the magazine's primary spring, then the balance would be much easier to strike, and more consistent and reliable feeding performance would be possible.

BRIEF SUMMARY

A paddle near the top of a magazine biases cartridges towards the feed lips. The bias provided by the paddle is consistent regardless of the state of the magazine's primary spring, contributing to reliability.

DETAILED DESCRIPTION OF PREFERRED EMBODIMENTS

Automatic and semi-automatic firearms (collectively known as self-loading firearms) frequently employ magazines to supply them with ammunition. The firing cycle for a typical magazine-fed firearm can be broken into three stages: (1) a cartridge is pushed (fed) from the magazine into the chamber by the bolt. At this time the magazine pushes a new cartridge into the feed position up against the underside of the bolt; (2) after firing, the bolt is driven rearward, pulling the expended cartridge out of the chamber; and (3) the bolt reaches the rear of its travel and begins moving forward, while the magazine rapidly pushes the cartridge upward and into the path of the bolt.

In a conventional prior art ammunition magazine intended for use in self-loading firearms, cartridges are fed from a cartridge storage area 2, through a throat, and up to a pair of feed lips located substantially symmetrically about the magazine centerline. For a box magazine, the throat and cartridge storage area may have identical or nearly identical dimensions, whereas a drum magazine will have a large spiral cartridge storage area and a narrow rectangular throat. In some magazines, both feed lips may contact the cartridge at the same time when presented for feeding, while in others, particularly double-stack rifle magazines, the cartridge will be caught between one of the feed lips and the cartridge below it. In all such magazines, the cartridge is presented for feeding through the action of a spring that presses on the first cartridge in the magazine, which transmits the force upward through all of the other cartridges. This design requires springs of carefully calibrated strength. In a fully loaded magazine, the spring must be able to overcome both the friction of the cartridges against the magazine, as well as their inertia, to ensure that during the brief period when the bolt is fully open, a cartridge can move upward into the feeding position. In a nearly empty magazine, the much more relaxed spring must still have enough remaining force to accomplish the same goal. A weak spring will fail to lift the round rapidly enough at some point during firing, leading to a bolt-over-base misfeed and a cessation in firing. However, an overly strong spring will exert excessive force against the underside of the bolt, which both makes a loaded magazine hard to insert during a "tactical reload," and may even cause a jam if bolt is unable to reach the rearmost part of its travel.

Figure 1:
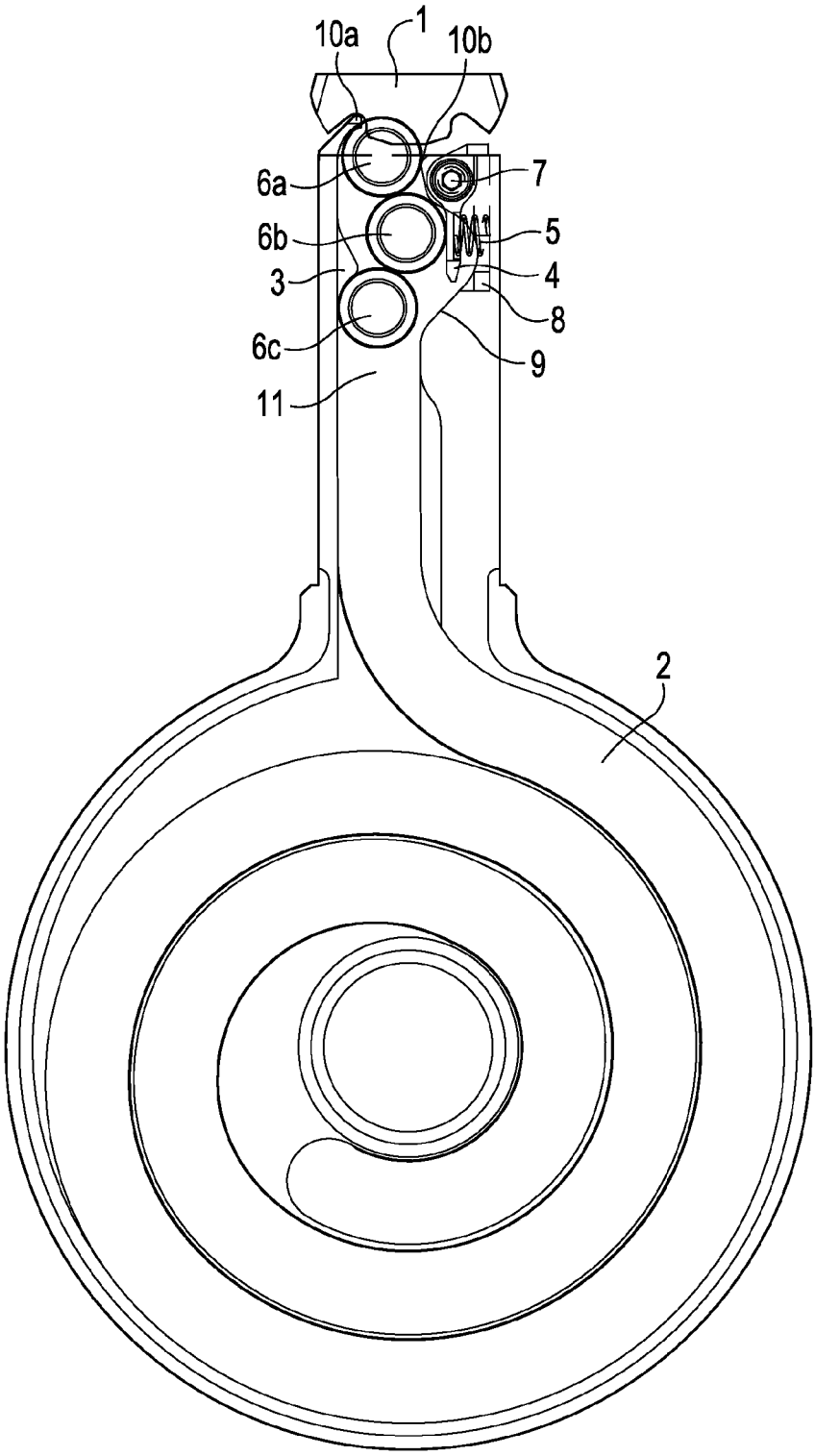
FIG. 1 is the front view of an exemplary embodiment installed in a prior art high capacity magazine. A typical firearm bolt and cartridges in the mechanism are also shown. The magazine has been sectioned and some components not relating to the exemplary embodiment are not shown.

To provide a more consistent level of pressure on the upper cartridges in a magazine regardless of the strength or level of compression in the magazine's primary spring, a modification in the throat 11 of the magazine is required. FIG. 1 shows an exemplary embodiment of one such modification made to the upper part of an otherwise conventional drum magazine. A ramp 3 absorbs some of the upward-directed force of the magazine's primary spring and directs the cartridges sideways into the cartridge pocket 9, which is a recess in the walls of the throat 11 (the primary spring and a follower, both well known in the art, are not depicted). Located in the cartridge pocket 9 is a paddle 4, which pivots around axis 7 and is biased into the throat by paddle spring 5. The paddle 4 exerts a consistent pressure on the cartridge 6*b* regardless of the degree to which the magazine's primary spring is compressed. This consistent pressure biases the cartridge 6*a* against the feed lips 10*a* and 10*b*. This consistent bias permits primary springs which are otherwise outside of the normal functional range to be used. An overly strong primary spring will have some of its force absorbed by ramp 3, preventing it from slowing the bolt 1 with excessive pressure. A weak primary spring will not have to bear the entire burden of moving cartridge 6*a* upward in front of the bolt 1, because it will receive assistance from paddle spring 5. Even if the primary spring moves cartridges too slowly to place them in front of the bolt 1 before firing, the paddle 4 can do so, and the slow-moving cartridges below will have time to get into position during the remainder of the firing cycle.

Figure 2:
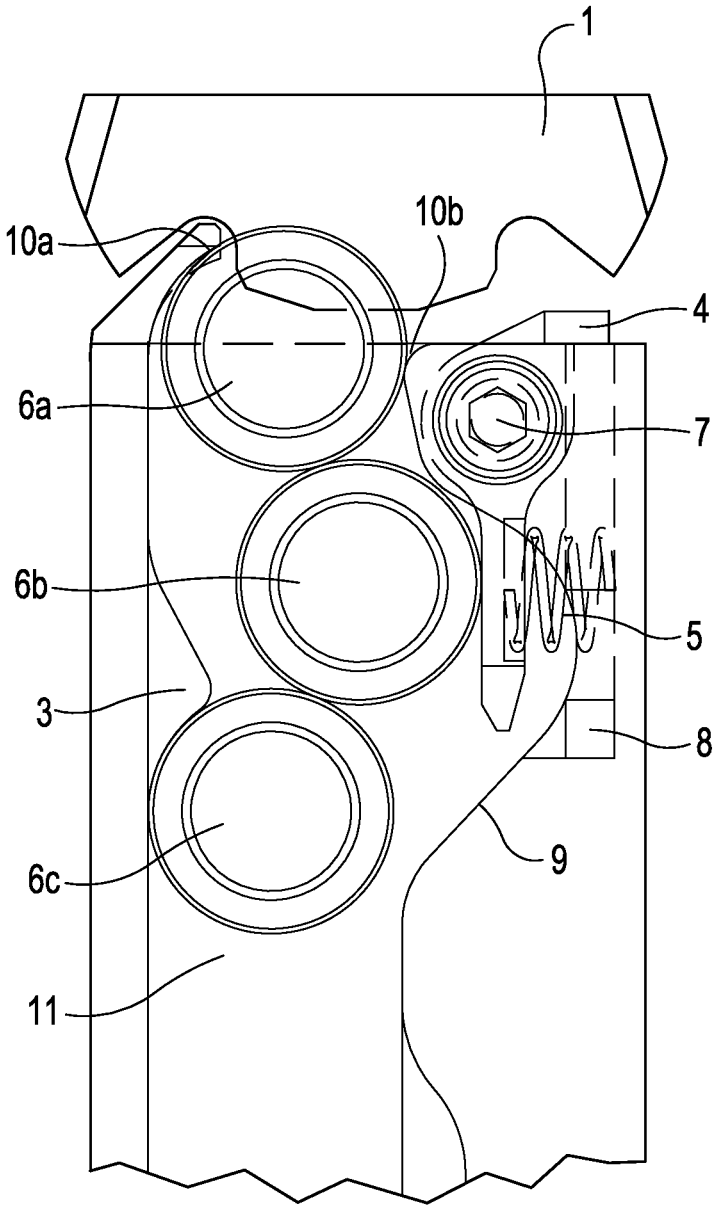
FIG. 2 is the front detail view of an exemplary embodiment at the beginning of the feed cycle.
Figure 3:
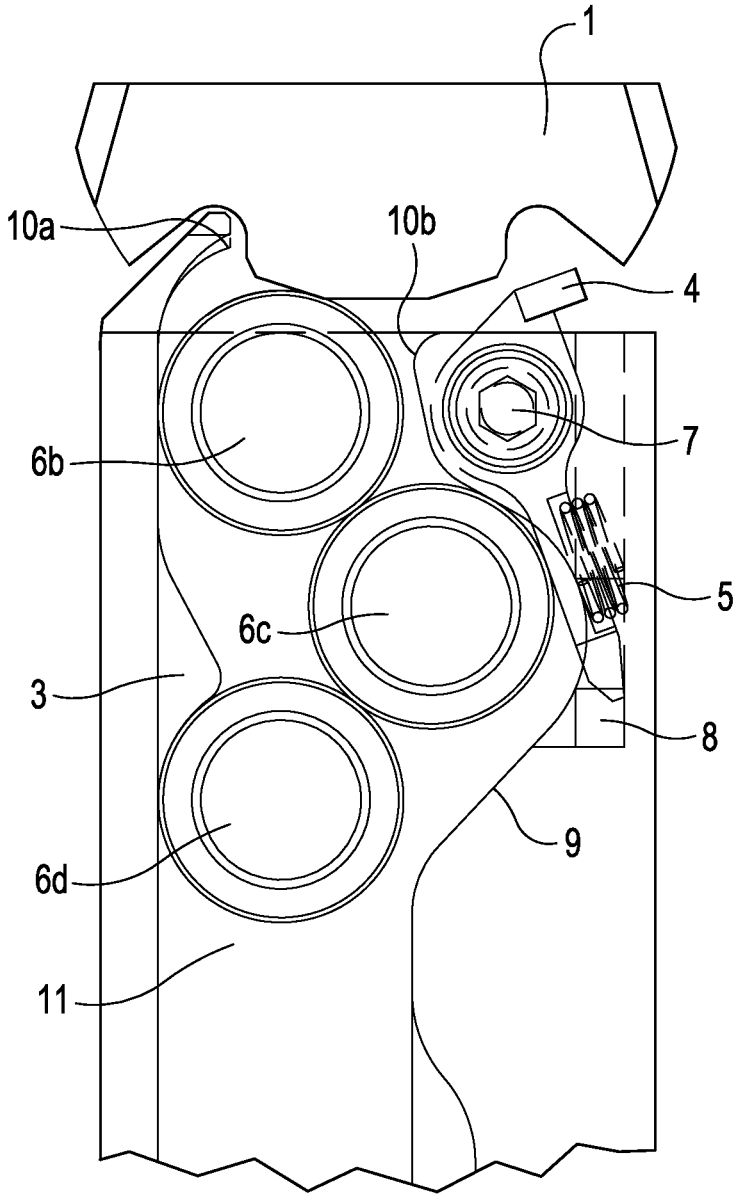
FIG. 3 is the front detail view of an exemplary embodiment when the bolt is closed, as during firing.

FIG. 2 depicts an exemplary embodiment when the bolt 1 is at the rearmost part of its travel and about to feed cartridge 6*a* into the chamber. Cartridge 6*a* is against feed lips 10*a* and 10*b* by the combined pressure of paddle spring 5 and the magazine's primary spring. When the bolt comes forward, it will strike the head of cartridge 6*a* and force it forward into the chamber. The chambering process is well known to those in the art. FIG. 3 shows what happens when the bolt has closed, taking cartridge 6*a* with it. Cartridge 6*b* moves up under the bolt, and cartridge 6*c* is pressed against paddle 4 by the force of cartridge 6*d*, which has moved up from below under the influence of the magazine's primary spring. The compression of spring 5 stores energy which will promptly lift cartridge 6*b* into the feeding position when the bolt opens again.

Figure 4:
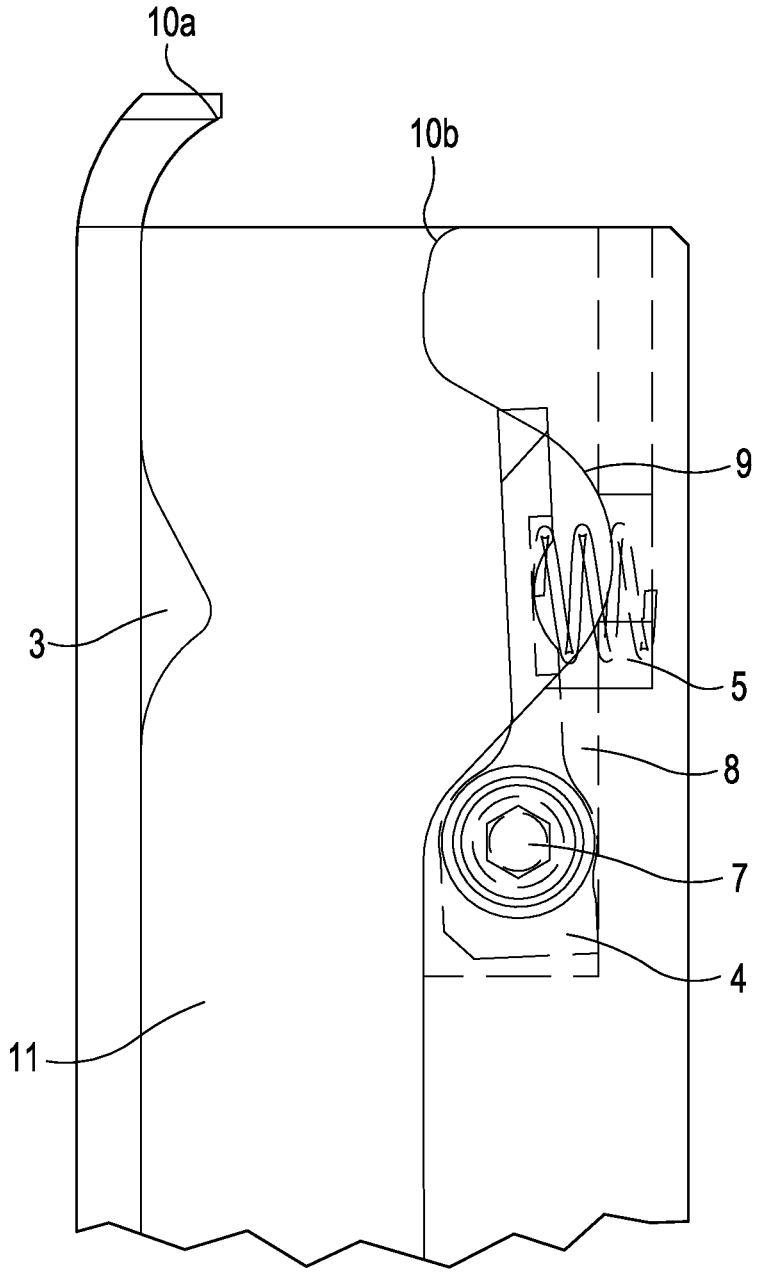
FIG. 4 is a front view of an alternate embodiment.
Figure 5:
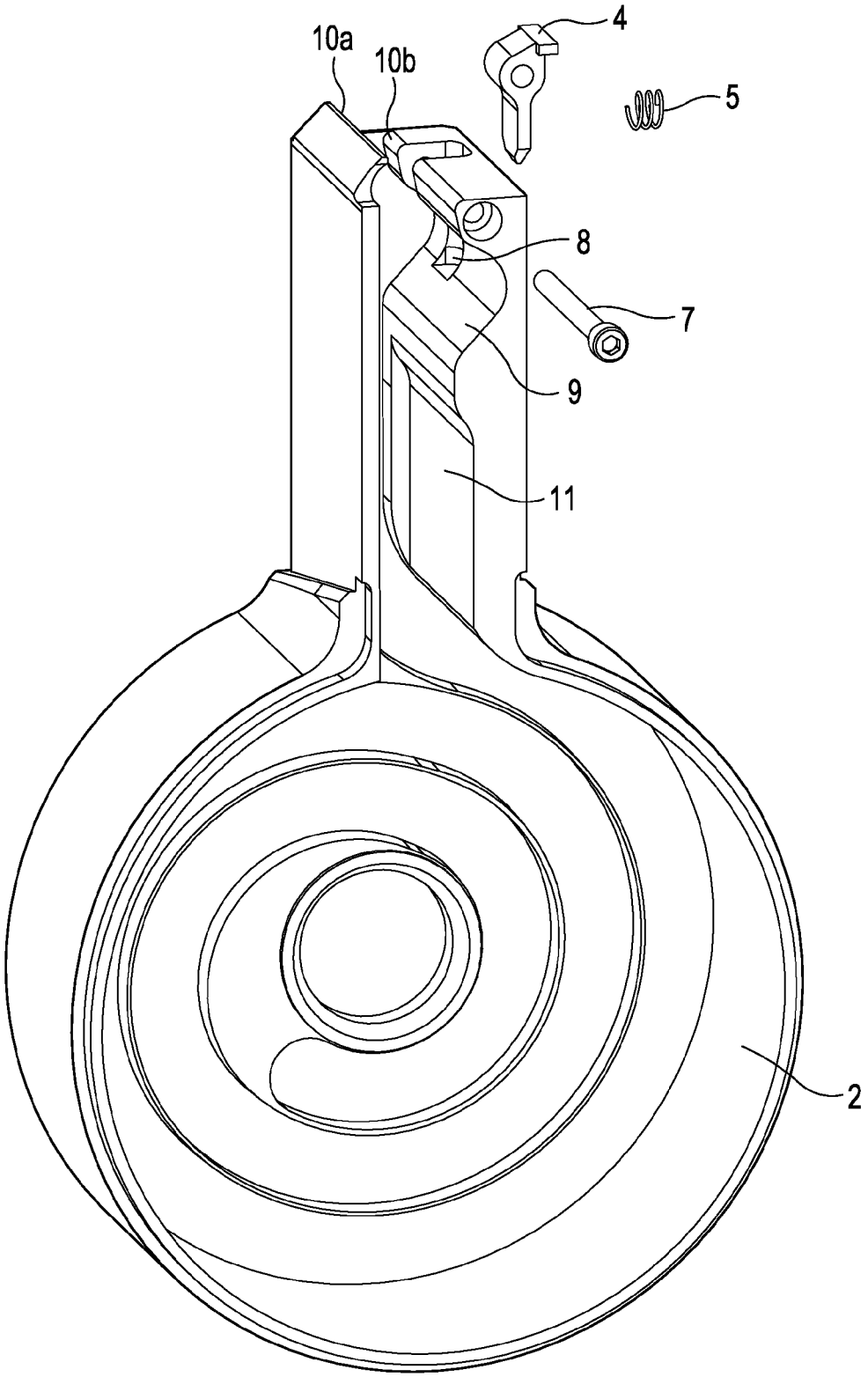
FIG. 5 is an exploded isometric view of an exemplary embodiment.

FIG. 4 depicts an alternative embodiment, which has a pivot 7 located below the cartridge pocket 9 rather than above it.

Although depicted as two pieces, the paddle 4 and paddle spring 5 can be constructed as a single piece which incorporates a spring portion, such as a leaf spring or a torsion spring.

We claim:

1. An ammunition feeding device comprising:

a. a cartridge storage compartment;

b. a feed lip;

c. a throat located between said cartridge storage area and said feed lip providing a passage for a cartridge to pass from one to the other;

d. a ramp protruding from a first side of said throat toward a second side of said throat and arranged to urge a cartridge toward said second side of said throat; and e. a paddle pivotally attached to said feeding device adjacent said throat and resiliently biased to pivot to urge a cartridge in said throat in a direction of said ramp, said first side of said throat and said feed lip.

2. The ammunition feeding device of claim 1 further comprising a pocket in said second side of said throat to receive a cartridge when deflected by said ramp.

3. The ammunition feeding device of claim 2 wherein receipt of a cartridge in said pocket increases said bias urging pivoting of said paddle.

4. The ammunition feeding device of claim 1 wherein said paddle pivots about an axis substantially parallel to said feed lip.

5. An ammunition feeding device comprising:

a. a throat comprising a first wall and an opposing, spaced apart second wall including a ramp projecting toward said first wall and arranged to urge a cartridge toward said first wall;

b. a feed lip arranged to contact a first cartridge storable between said first wall and said second wall; and c. a paddle pivotally attached to said feeding device proximate said first wall and biased to urge a second cartridge in contact with said first cartridge toward the ramp and the feed lip.

6. The ammunition feeding device of claim 5 further comprising a pocket in said first wall to receive said second cartridge when deflected by said ramp.

7. The ammunition feeding device of claim 6 wherein receipt of said second cartridge in said pocket increases said bias urging pivoting of said paddle.

8. The ammunition feeding device of claim 5 wherein said paddle pivots about an axis substantially parallel to said feed lip.

9. A firearm comprising:

a. a magazine having a throat comprising a first wall and an opposing second wall including a ramp projecting toward said first wall and arranged to urge a cartridge toward said first wall, an end portion of at least one of said first wall and said second wall comprising a feed lip, plural cartridges storable between said first wall and said second wall, a stored first cartridge urged into contact with said feed lip;

b. a paddle pivotally mounted adjacent said throat biased to urge a second cartridge in contact with said first cartridge toward said ramp and said feed lip;

c. a bolt movable to contact said first cartridge and move said first cartridge out of contact with said feed lip.

10. The firearm of claim 9 further comprising a pocket in said second wall to receive a third cartridge storable in said magazine in contact with said second cartridge, said third cartridge pivoting said paddle against said bias when deflected into said pocket by said ramp when said first cartridge is moved out of contact with said feed lip and said second cartridge moves into contact with said feed lip.

* * * * *